US012497748B2

(12) United States Patent
Rau et al.

(10) Patent No.: US 12,497,748 B2
(45) Date of Patent: Dec. 16, 2025

(54) ATTACHMENT TOOL COUPLING ASSEMBLY FOR A CONSTRUCTION VEHICLE

(71) Applicant: CNH Industrial America LLC, New Holland, PA (US)

(72) Inventors: Paul Wilhelm Rau, Plain City, UT (US); Richard Lee Niespodzany, Pulaski, WI (US); Lonnie L. McGee, Jr., Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 267 days.

(21) Appl. No.: 18/198,613

(22) Filed: May 17, 2023

(65) Prior Publication Data

US 2024/0384496 A1 Nov. 21, 2024

(51) Int. Cl.
*E02F 3/36* (2006.01)

(52) U.S. Cl.
CPC ..... *E02F 3/3622* (2013.01); *E02F 3/3663* (2013.01)

(58) Field of Classification Search
None
See application file for complete search history.

(56) References Cited

U.S. PATENT DOCUMENTS

| | | | | |
|---|---|---|---|---|
| 1,867,187 | A * | 7/1932 | Soule | E01H 5/06 37/231 |
| 6,132,131 | A | 10/2000 | Nakamura et al. | |
| 6,922,926 | B2 | 8/2005 | Miller et al. | |
| 7,473,067 | B2 | 1/2009 | Nishioka et al. | |
| 7,779,562 | B1 * | 8/2010 | Loveless | E02F 3/3686 37/231 |
| 7,836,616 | B2 * | 11/2010 | Esser | E02F 3/3686 37/468 |
| 8,662,817 | B2 | 3/2014 | Daraie et al. | |
| 8,936,428 | B1 * | 1/2015 | Page | B66F 9/18 414/920 |
| 9,284,712 | B2 | 3/2016 | Bradley et al. | |
| 9,562,343 | B2 * | 2/2017 | Paull | E02F 5/027 |
| 9,926,685 | B1 * | 3/2018 | Reinert | E02F 3/3686 |
| 10,316,488 | B2 | 6/2019 | Nair et al. | |
| 12,116,750 | B2 * | 10/2024 | Thompson | E02F 3/365 |
| 2015/0275469 | A1 * | 10/2015 | Fredrickson | E02F 9/265 701/50 |

FOREIGN PATENT DOCUMENTS

| | | |
|---|---|---|
| JP | 2004-060371 A | 2/2004 |

* cited by examiner

*Primary Examiner* — Michael S Lowe
(74) *Attorney, Agent, or Firm* — Dority & Manning, P.A.

(57) ABSTRACT

Work vehicles, such as construction vehicles, include an attachment tool to transport material. The attachment tool is coupled to a lift arm assembly of the construction vehicle via a coupling assembly. The coupling assembly is designed to be coupled to any one of a variety of attachment tools. However, coupling assemblies commonly utilize coupling pins to couple the attachment tool to the lift arm assembly. The coupling pins are onerous to insert/remove and prone to rusting. Furthermore, the coupling assemblies often have too much lateral tolerance. As such, the attachment tools are prone to lateral movement relative to the lift arm during operation. Therefore, an attachment tool coupling assembly for a construction vehicle is needed to easily couple and release the attachment tool from the lift arm assembly and prevent lateral movement of the attachment tool relative to the lift arm assembly.

21 Claims, 14 Drawing Sheets

ATTACHMENT TOOL COUPLING ASSEMBLY FOR A CONSTRUCTION VEHICLE

FIELD OF THE INVENTION

The present disclosure generally relates to work vehicles, such as construction vehicles, and, more particularly, to an attachment tool coupling assembly for a construction vehicle.

BACKGROUND OF THE INVENTION

A wide variety of work vehicles, such as construction vehicles, have been developed for various purposes. Certain construction vehicles may include a backhoe or excavator for transporting large, loose, and/or awkward material. For instance, a tractor-loader-backhoe or an excavator may be used to remove large amounts of material such as gravel, dirt, or similar substances. These construction vehicles commonly include an attachment tool, which is used to transport the material. The attachment tool is often coupled to a lift arm assembly of the construction vehicle via a coupling assembly. The coupling assembly is often designed to be coupled to any one of a variety of attachment tools (e.g., buckets, claws, etc.). However, such coupling assemblies commonly utilize a set of removable coupling pins to couple the attachment tool to the lift arm assembly which are onerous to insert/remove. Coupling pins are also prone to rusting while inserted, which makes the coupling pins even more difficult to remove. Furthermore, to incorporate the different widths of the variety of attachment tools, the coupling assemblies often have too much lateral tolerance. As such, the attachment tools are prone to lateral movement relative to the lift arm assembly during operation. To resolve the issue, operators commonly use shims to eliminate the gaps between the attachment tool and the coupling assembly. However, shims are prone to falling off during operation of the construction vehicle and are intended only for temporary use.

Accordingly, an attachment tool coupling assembly for a construction vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a construction vehicle. The construction vehicle includes a frame, a lift arm assembly pivotably coupled to the frame, and an attachment tool including at least one coupling member. Additionally, the construction vehicle includes a coupling assembly configured to couple the attachment tool to the lift arm assembly. The coupling assembly includes a first grip plate defining a universal grip plate slot configured to receive the at least one coupling member of the attachment tool. The first grip plate is configured to slide along a lateral direction relative to the lift arm assembly between a first position and a second position. Furthermore, the coupling assembly includes a second grip plate defining a universal grip plate slot configured to receive the at least one coupling member. The second grip plate is configured to slide along the lateral direction relative to the lift arm assembly between a first position and a second position. Moreover, the coupling assembly includes a first actuator configured to actuate the first grip plate such that the first grip plate slides along the lateral direction away from the second grip plate. Likewise, the coupling assembly includes a second actuator configured to actuate the second grip plate such that the second grip plate slides along the lateral direction away from the first grip plate. Additionally, the first grip plate and the second grip plate are configured to prevent the attachment tool from moving along the lateral direction relative to the lift arm assembly when the first grip plate is in the second position and the second grip plate is in the second position.

In another aspect, the present subject matter is directed to a system for coupling an attachment tool to a lift arm assembly of a construction vehicle. The system includes a first grip plate defining a universal grip plate slot configured to receive a coupling member of the attachment tool. The first grip plate is configured to slide along a lateral direction between a first position and a second position. Furthermore, the system includes a second grip plate defining a universal grip plate slot configured to receive the coupling member of the attachment tool. The second grip plate is configured to slide along the lateral direction between a first position and a second position. Moreover, the system includes a first actuator configured to actuate the first grip plate such that the first grip plate slides along the lateral direction away from the second grip plate. Likewise, the system includes a second actuator configured to actuate the second grip plate such that the second grip plate slides along the lateral direction away from the first grip plate. Furthermore, the first grip plate and the second grip plate are configured to prevent the attachment tool from moving along the lateral direction relative to the lift arm assembly when the first grip plate is in the second position and the second grip plate is in the second position.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
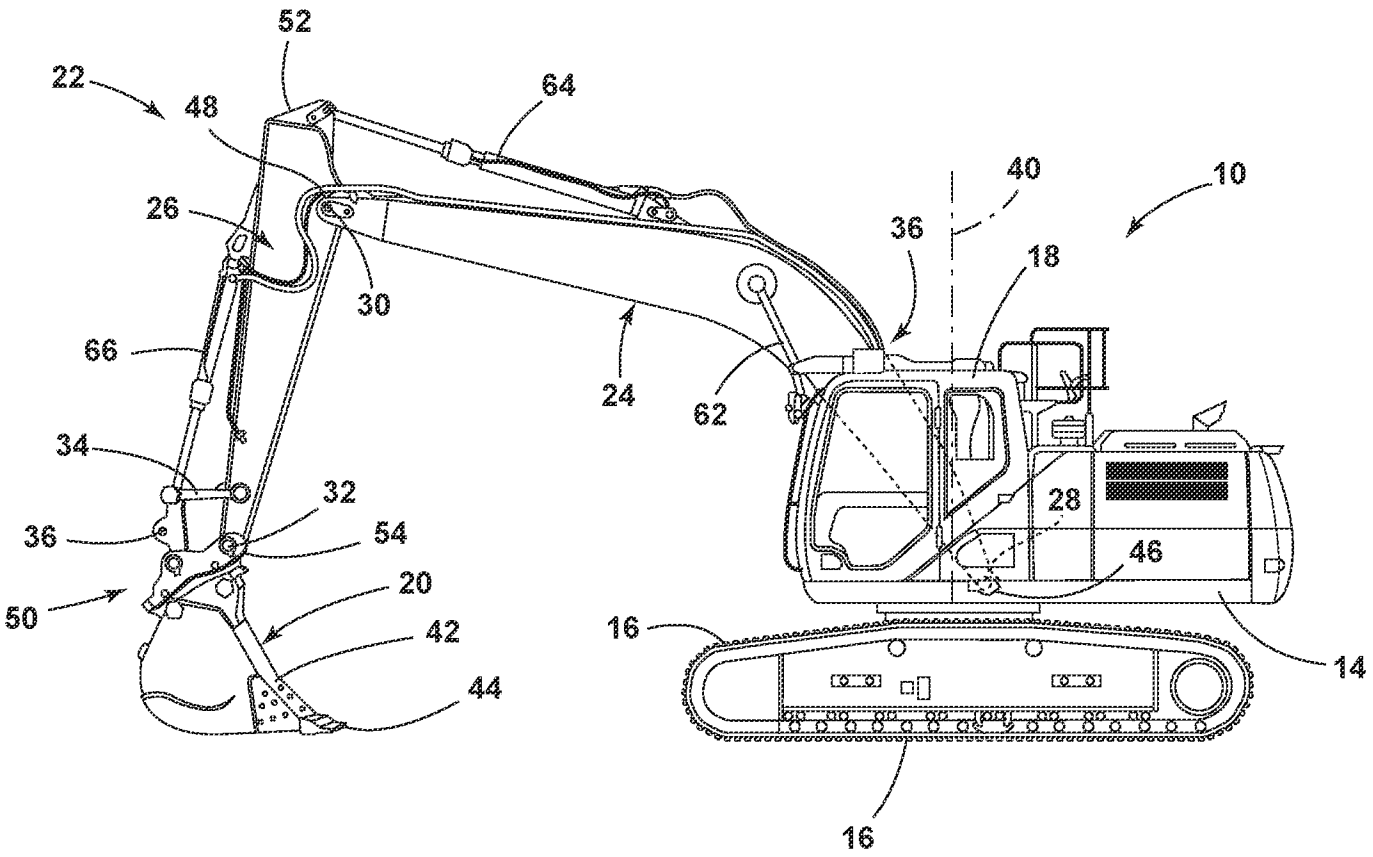
FIG. 1 illustrates a side view of one embodiment of a construction vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a work vehicle, such as a construction vehicle, with an attachment tool coupling assembly. Specifically, in several embodiments, the construction vehicle includes a frame, a lift arm assembly pivotably coupled to the frame, and an attachment tool (e.g., a bucket) coupled to the lift arm. Furthermore, the construction vehicle includes a coupling assembly configured to couple the attachment tool to the lift arm assembly. The coupling assembly, in turn, includes one or more grip plates each defining a universal grip plate slot configured to receive a coupling member of the attachment tool therein. The universal grip plate slots allow the grip plates to receive various diameters of coupling members and thus be coupled to various attachment tools. For example, in some embodiments, the coupling assembly includes a first grip plate and a second grip plate each defining a universal grip plate slot that allows the grip plates to receive various diameters of coupling members and thus be coupled to various attachment tools, configured to receive a coupling member of the attachment tool therein. The first and second grip plates are configured to slide along a lateral direction relative to the lift arm assembly between a first position and a second position.

The coupling assembly also includes one or more actuators configured to actuate the grip plates such that the grip plates slide along the lateral direction away from each other. For example, in some embodiments, the coupling assembly includes a first actuator configured to actuate the first grip plate such that the first grip plate slides along the lateral direction away from the first grip plate. The first actuator may be coupled to the first grip plate and configured as a first hydraulic actuator including a piston configured to apply a force to a cam link of the coupling assembly to slide the first grip plate along the lateral direction away from the cam link, which is also away from the second grip plate. The first hydraulic actuator may be activated by a computing system. Likewise, in some embodiments, the coupling assembly includes a second actuator configured to actuate the second grip plate such that the second grip plate slides along the lateral direction away from the first grip plate. Similar to the first actuator, the second actuator may be coupled to the second grip plate and configured as a second hydraulic actuator including a piston configured to apply a force to the cam link of the coupling assembly to slide the second grip plate along the lateral direction away from the cam link, which is also away from the first grip plate. The second hydraulic actuator may also be activated by a computing system. The first grip plate and the second grip plate are also configured to prevent the attachment tool from moving along the lateral direction relative to the lift arm assembly when the first grip plate and the second grip plate are in their respective second positions.

As mentioned previously, conventional coupling assemblies often utilize a set of removable coupling pins to couple the attachment tool to the lift arm assembly, which are onerous to insert/remove. Coupling pins are also prone to rusting while inserted, which makes the coupling pins even more difficult to remove. Furthermore, conventional coupling assemblies often have too much lateral tolerance in order to incorporate the various coupling member widths of the variety of attachment tools, and, as a result, the attachment tools are prone to lateral movement relative to the lift arm assembly during operation. However, the disclosed coupling assembly includes grip plates that are moveable between first and second positions, such as via actuators, to couple attachment tools to lift arm assemblies of construction vehicles, which makes attachment tool coupling easier for operators of construction vehicles. The universal grip plate slots allow a variety of attachment tools with coupling members of various diameters to be coupled to lift arm assemblies of construction vehicles without lateral movement of the attachment tool relative to the lift arm assemblies.

Referring now to drawings, FIG. 1 illustrates a side view of one embodiment of a construction vehicle 10 in accordance with aspect of the present subject matter. As shown in the illustrated embodiment, the construction vehicle 10 is configured as an excavator. However, in other embodiments, the construction vehicle 10 may be configured as any other suitable construction vehicle (e.g., a loader, shovel, bulldozer, etc.), an agricultural vehicle, and/or the like.

As shown in FIG. 1, the construction vehicle 10 includes a frame or chassis 14 coupled to and supported by a pair of tracks 16 for movement across a worksite. However, in other embodiments, the chassis 14 may be supported in any other way, for example by wheels, a combination of wheels and tracks, or a fixed platform. In some embodiments, an operator's cab 18 may be supported by a portion of the chassis 14 and may house a user interface 60 (FIG. 4) comprising various input devices for permitting an operator to control the operation of one or more components of the construction vehicle 10. However, it should be appreciated that, in some embodiments, one or more components of the user interface 60 (FIG. 4) may be positioned remotely from the construction vehicle 10. The chassis 14 may, in some embodiments, be configured such that the operator's cab 18 is pivotable about a chassis axis 40.

Additionally, the construction vehicle 10 includes an attachment tool 20 articulable relative to the chassis 14 for performing earth moving operations within a worksite. The chassis 14 may, in some embodiments, be configured such that the attachment tool 20 is pivotable about a chassis axis 40. The attachment tool 20, in one embodiment, is configured as a bucket having a cavity 42 and a plurality of teeth 44, where the teeth 44 help to break up worksite materials for collection within the cavity 42. However, in other embodiments, the attachment tool 20 may be configured as any other suitable ground engaging tool, such as a claw, and/or the like.

Furthermore, the construction vehicle 10 includes a lift arm assembly 22 coupled thereto. In several embodiments, the lift arm assembly 22 includes a boom arm 24, a dipper arm 26, a driving link 34, and a driven link 36. The boom arm 24, in turn, extends between a first end 46 and a second end 48. Similarly, the dipper arm 26 extends between a first end 52 and a second end 54. The first end 46 of the boom arm 24 is pivotably coupled to the chassis 14 of the construction vehicle 10 about a first pivot axis 28, and the second end 48 of the boom arm 24 is pivotably coupled to the first end 52 of the dipper arm 26 about a second pivot axis 30. The driving link 34 is pivotably coupled to the second end 54 of the dipper arm 26. The driven link 36 is pivotably coupled to the driving link 34.

Figure 4:
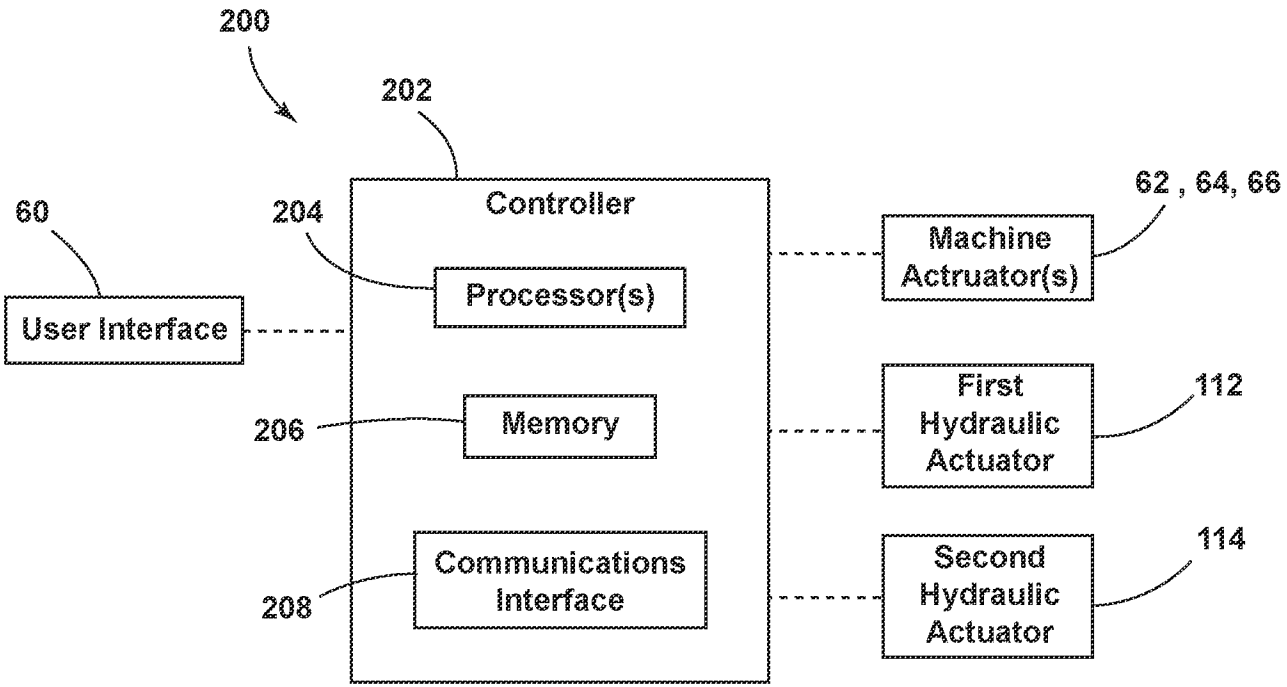
FIG. 4 illustrates a schematic view of one embodiment of a system for coupling the attachment tool to the lift arm assembly of the construction vehicle in accordance with aspects of the present subject matter.

Moreover, the construction vehicle 10 includes a coupling assembly 50, which will be described in detail below in reference to FIG. 2, configured to pivotably couple the attachment tool 20 to the lift arm assembly 22 of the construction vehicle 10. For example, as shown in FIG. 1, the coupling assembly 50 is pivotably coupled to the second end 54 of the dipper arm 26, pivotably coupled to the driven link 36, and fixedly coupled to the attachment tool 20 such that the attachment tool 20 is pivotable relative to the dipper arm 26. The attachment tool 20 includes one or more coupling members, such as a first coupling pin 56 (FIG. 2) and a second coupling pin 58 (FIG. 2), which are coupled to the coupling assembly 50. Furthermore, as will be described below, the coupling assembly 50 may be electronically controlled. For example, the coupling assembly 50 may be controlled by the operator via the user interface 60 (FIG. 4). However, it should be appreciated that the coupling assembly 50 may be controlled in any other suitable manner.

Additionally, in several embodiments, the lift arm assembly 22 further includes a plurality of lift arm actuators for actuating components 20, 24, 26 of the lift arm assembly 22. For instance, a first lift arm actuator 62 may be coupled between the boom arm 24 and the chassis 14 for pivoting the boom arm 24 relative to the chassis 14. Similarly, a second lift arm actuator 64 may be coupled between the boom arm 24 and the dipper arm 26 for pivoting the dipper arm 26 relative to the boom arm 24. Further, a third lift arm actuator 66 may be coupled between the dipper arm 26 and the driving link 34 for pivoting the attachment tool 20 relative to the dipper arm 26. In one embodiment, the lift arm actuators 62, 64, 66 are configured as hydraulic cylinders. However, it should be appreciated that the lift arm actuators 62, 64, 66 may be configured as any other suitable type, number, or combination of actuators.

By selectively pivoting the components 24, 24, 26 of the lift arm assembly 22, the attachment tool 20 may perform various earthmoving operations within a worksite. The lift arm actuators 62, 64, 66 of the construction vehicle 10 may be controlled by a computing system 202 (FIG. 4) of the disclosed system. For instance, the lift arm actuators 62, 64, 66 of the construction vehicle 10 may be used to determine the current fill of the attachment tool 20 (e.g., based on the force(s) of the actuator(s) used to actuate the attachment tool 20) and/or the position of the attachment tool 20. The computing system 202 (FIG. 4) of the disclosed system may also be used to perform other tasks as will be described in detail below in reference to FIG. 4.

It should be appreciated that the configuration of the construction vehicle 10 described above and shown in FIG. 1 is provided only to place the present subject matter in an exemplary field of use. Thus, it should be appreciated that the present subject matter may be readily adaptable to any manner of construction vehicle configuration. For example, in an alternative embodiment, the construction vehicle 10 may further include any other tools, implements, and/or components appropriate for use with a construction vehicle 10.

Figure 2:
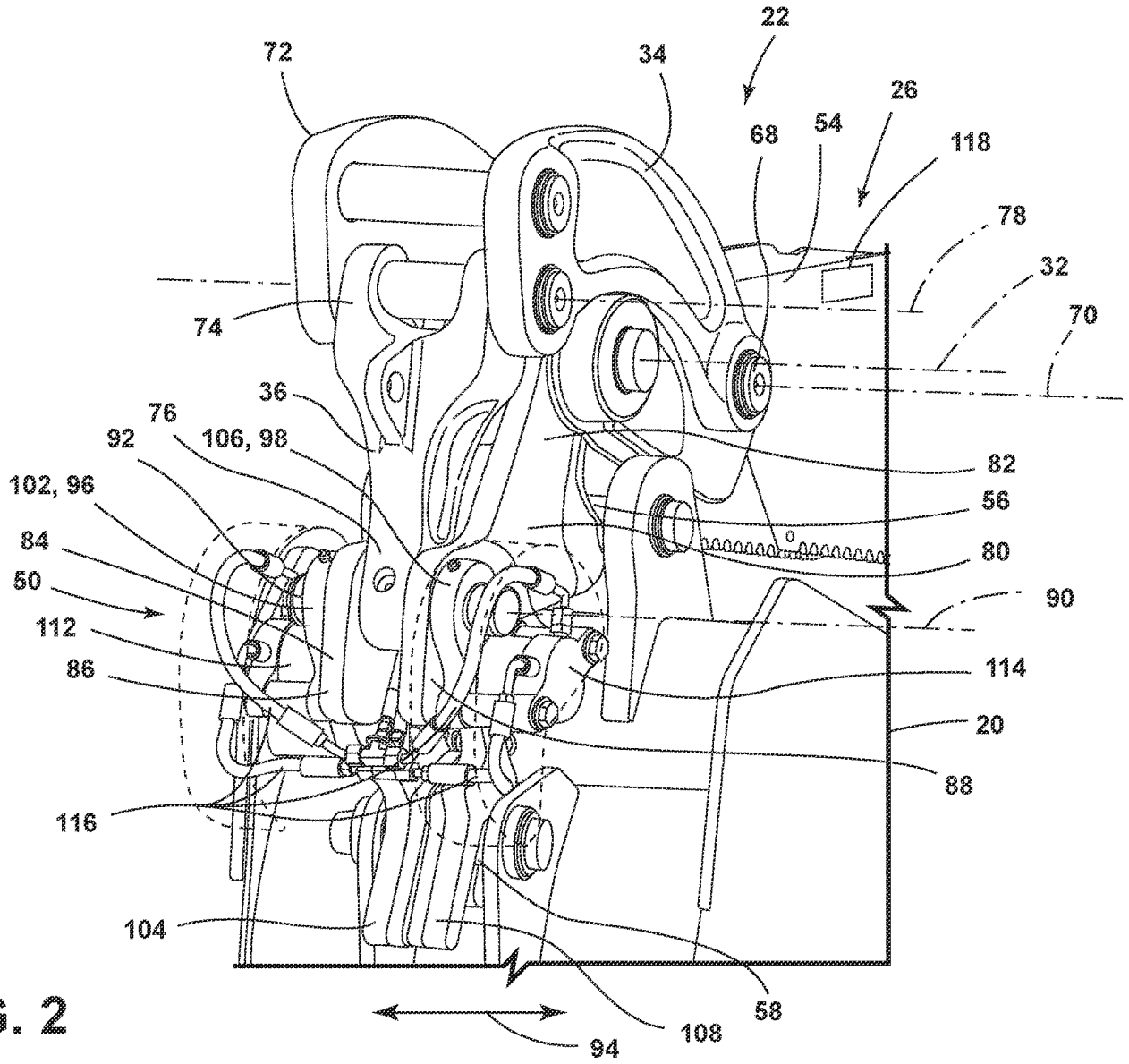
FIG. 2 illustrates a perspective view of the embodiment of the construction vehicle shown in FIG. 1, particularly illustrating a coupling assembly coupling an attachment tool to a lift arm assembly of the construction vehicle.

Referring now to FIG. 2, a perspective view of the coupling assembly 50 of the FIG. 1 construction vehicle is illustrated. In particular, FIG. 2 shows the coupling assembly 50 coupling an attachment tool 20 to a lift arm assembly 22 of the construction vehicle 10.

As described above, the lift arm assembly 22 may include the driving link 34 coupled to the second end 54 of the dipper arm 26. As shown in FIG. 2, the driving link 34 extends from a first end 68 to a second end 72. The first end 68 of the driving link 34 is, in turn, pivotably coupled to the dipper arm 26 of the lift arm assembly 22 such that the driving link 34 is pivotable about a fourth pivot axis 70 relative to the dipper arm 26. For example, the third lift arm actuator 66 (FIG. 1) may be coupled to the driving link 34 such that the third lift arm actuator 66 is configured to pivot the driving link 34 about the fourth pivot axis 70.

Additionally, the lift arm assembly 22 may include the driven link 36 coupled to the driving link 34. As shown in FIG. 2, the driven link 36 extends from a first end 74 to a second end 76. The first end 74 of the driven link 36, in turn, is pivotably coupled to the second end 76 of the driving link 34 such that the driven link 36 is pivotable relative to the driving link 34 about a fifth pivot axis 78.

Furthermore, the coupling assembly 50 is configured to pivotably couple the attachment tool 20 to the lift arm assembly 22 of the construction vehicle 10. In this respect, the coupling assembly 50 may include a cam link 80 coupled to the second end 54 of the dipper arm 26 and coupled to the driven link 36. The cam link 80 may extend from a first end 82 to a second end 84. The first end 82 of the cam link 80, in turn, may be pivotably coupled to the dipper arm 26 such that the cam link 80 may be pivotable relative to the dipper arm 26 about a third pivot axis 32. Likewise, the second end 84 of the cam link 80 may be pivotably coupled to the driven link 36 such that the cam link 80 is pivotable relative to the driven link 36 about a sixth pivot axis 90. The cam link 80 may also be coupled to the attachment tool 20 as will be described below with reference to FIG. 3.

Moreover, the cam link 80 may be coupled to the driven link 36 via a slide pin 92 defining the sixth pivot axis 90. As shown in FIG. 2, the cam link 80 includes a first side 86 and a second side 88 separated from the first side 86 along a lateral direction 94 relative to the lift arm assembly 22. In this respect, the second end 84 of the cam link 80 is configured to receive the second end 76 of the driven link 36 between the first side 86 and the second side 88. The first side 86 and the second side 88 each define a cam link hole. Likewise, the second end 76 of the driven link 36 defines a driven link hole. As such, the cam link holes and the driven link hole are aligned such that the slide pin 92 is received therethrough.

Additionally, the coupling assembly 50 includes one or more grip plates. For example, in several embodiments, the coupling assembly 50 may include first and second grip plates 96, 98 coupled to the cam link 80. As shown in FIG. 2, the first grip plate 96 extends from a first end 102 to a second end 104. Likewise, the second grip plate 98 extends from a first end 106 to a second end 108. The first end 102 of the first grip plate 96 and the first end 106 of the second grip plate 98 are pivotably coupled to the second end 84 of the cam link 80 such that the first grip plate 96 and the second grip plate 98 are pivotable relative to the cam link 80 about the sixth pivot axis 90. Furthermore, the first end 102 of the first grip plate 96 and the first end 106 of the second grip plate 98 are spaced apart from each other along the lateral direction 94 relative to the lift arm assembly 22 such that the second end 84 of the cam link 80 is received therebetween. The first ends 102, 106 of the first and second grip plates 96, 98 are coupled to the second end 84 of the cam link 80 via the slide pin 92. As such, the first grip plate 96 and the second grip plate 98 each define a slide pin hole. The slide pin hole of the first grip plate 96 and the slide pin hole of the second grip plate 98 are aligned with the cam link holes and the driven link hole such that slide pin 92 is received therethrough.

Figure 9A:
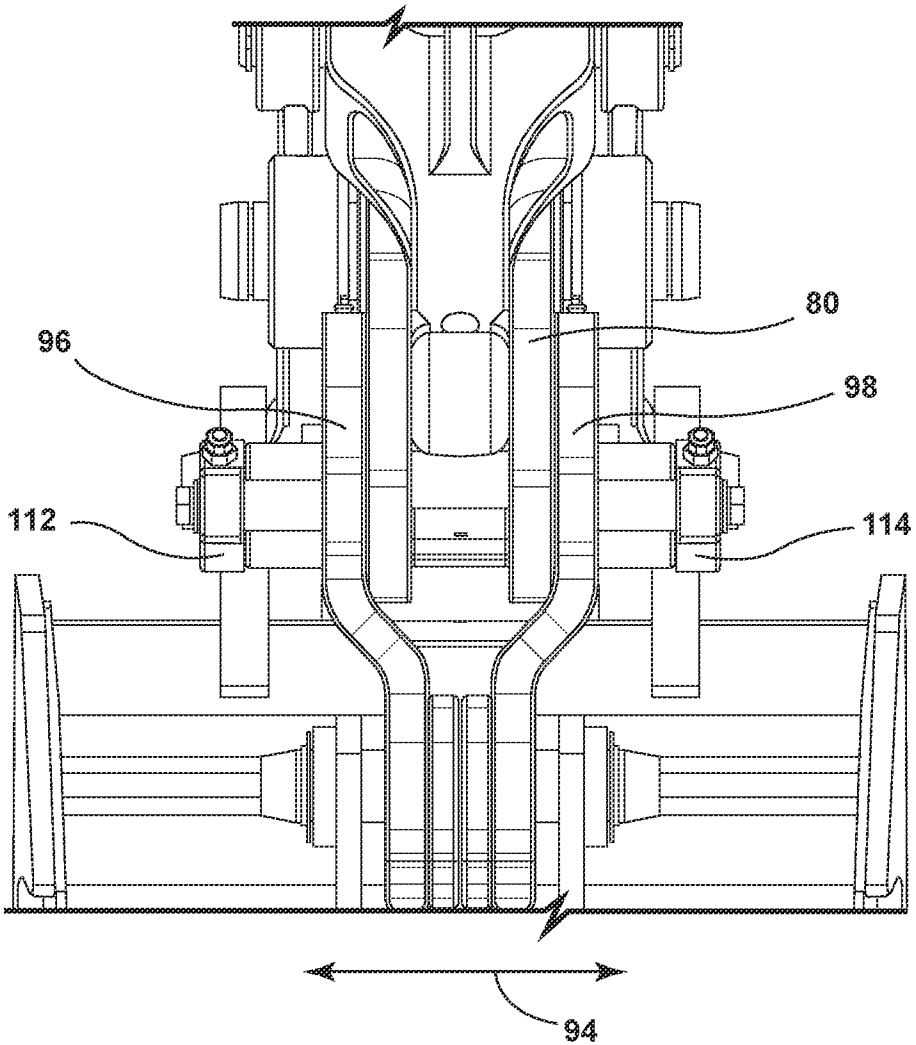
FIG. 9A illustrates a perspective view of the embodiment of the construction vehicle shown in FIG. 1, particularly illustrating the FIG. 5 control logic for coupling the attachment tool to the lift arm assembly of the construction vehicle.
Figure 9B:
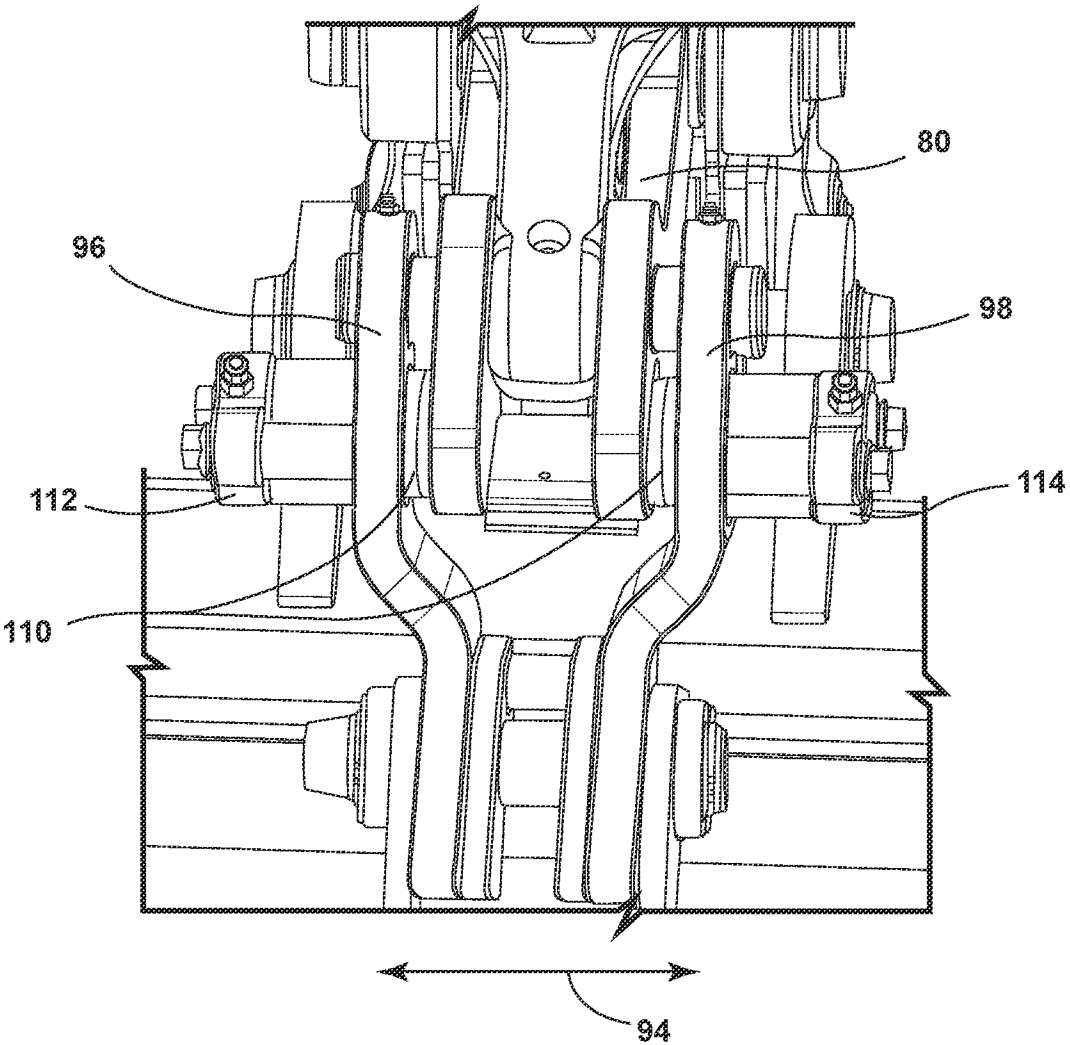
FIG. 9B illustrates a perspective view of the embodiment of the construction vehicle shown in FIG. 1, particularly illustrating the FIG. 5 control logic for coupling the attachment tool to the lift arm assembly of the construction vehicle.

Moreover, the first grip plate 96 is configured to slide along the lateral direction 94 relative to the lift arm assembly 22 between a first position (FIG. 9A) and a second position (FIG. 9B). Likewise, the second grip plate 98 is configured to slide along the lateral direction 94 relative to the lift arm assembly 22 between a first position and a second position. For example, as will be described in detail below with reference to FIGS. 9A and 9B, the first grip plate 96 and the second grip plate 98 may each be configured to slide along the slide pin 92 and the second coupling pin 58 of the attachment tool 20 between the first position and the second position. As such, the first grip plate 96 and the second grip plate 98 are configured to prevent the attachment tool 20 from moving along the lateral direction 94 relative to the lift arm assembly 22 when the first grip plate 96 is in a second position and the second grip plate 98 is in a second position.

Furthermore, the first grip plate 96 and the second grip plate 98 may each define a piston hole. The piston hole of the first grip plate 96 is configured to receive an actuator piston, such as a piston 110 (FIG. 9B) of a first actuator 112 of the coupling assembly 50. The first actuator 112 is configured to move the first grip plate 96 from the first position to the second position. Likewise, the piston hole of the second grip plate 98 is configured to receive an actuator piston, such as a piston 110 (FIG. 9B) of a second actuator 114 of the coupling assembly 50. The second actuator 114 is configured to move the second grip plate 98 from the first position to the second position.

Additionally, as mentioned above, the coupling assembly 50 may include a first actuator 112 and a second actuator 114. For example, the first actuator 112 may be configured as a first hydraulic actuator, and the second actuator 114 may be configured as a second hydraulic actuator. The first actuator 112 includes the piston 110 (FIG. 9B) mentioned previously and is coupled to the first grip plate 96, and the second actuator 114 includes the piston 110 (FIG. 9B) mentioned previously and is coupled to the second grip plate 98. The first actuator 112 is configured to move the first grip plate 96 such that the first grip plate 96 slides along the lateral direction 94 relative to the lift arm assembly 22 away from the second grip plate 98. Likewise, the second actuator 114 is configured to move the second grip plate 98 such that the second grip plate 98 slides along the lateral direction 94 relative to the lift arm assembly 22 away from the first grip plate 96. As will be described below in reference to FIG. 4, the first actuator 112 and the second actuator 114 are controlled by the computing system 202.

Moreover, the first actuator 112 and the second actuator 114 may receive a hydraulic fluid pressure from a hydraulic fluid source. Such hydraulic fluid may, in turn, actuate the first actuator 112 and the second actuator 114. In this respect, the first actuator 112 and the second actuator 114 may receive the hydraulic fluid pressure via one or more hydraulic tubes 116. The hydraulic tube(s) 116 may be coupled to and extend from the hydraulic fluid source to the first actuator 112 and the second actuator 114. In this regard, as shown in FIG. 2, the hydraulic tube(s) 116 may be routed between the first side 86 of the cam link 80 and the second side of the cam link 80 from the hydraulic fluid source to the first actuator 112 and the second actuator 114. As such, the hydraulic tube(s) 116 may avoid interference with by other components of the construction vehicle 10.

Furthermore, in some embodiments, the hydraulic tube(s) 116 may be coupled to a locking valve 118 configured to prevent the deactivation of the first actuator 112 and/or the second actuator 114 due to loss of the hydraulic fluid pressure. For example, once the first and second grip plates 96 are in the second position, the locking valve 118 may prevent the loss of the hydraulic fluid pressure such that neither the first grip plate 96 nor the second grip plate 98 move from their respective second positions. As a result, the attachment tool 20 will not move along the lateral direction 94 relative to the lift arm assembly 22. As shown in FIG. 2, the locking valve 118 is coupled to the dipper arm 26 of the lift arm assembly 22. However, the locking valve 118 may be coupled to at any other suitable location on the construction vehicle 10 to prevent the deactivation of the first and/or second actuators 112, 114 due to loss of the hydraulic fluid pressure.

Figure 3:
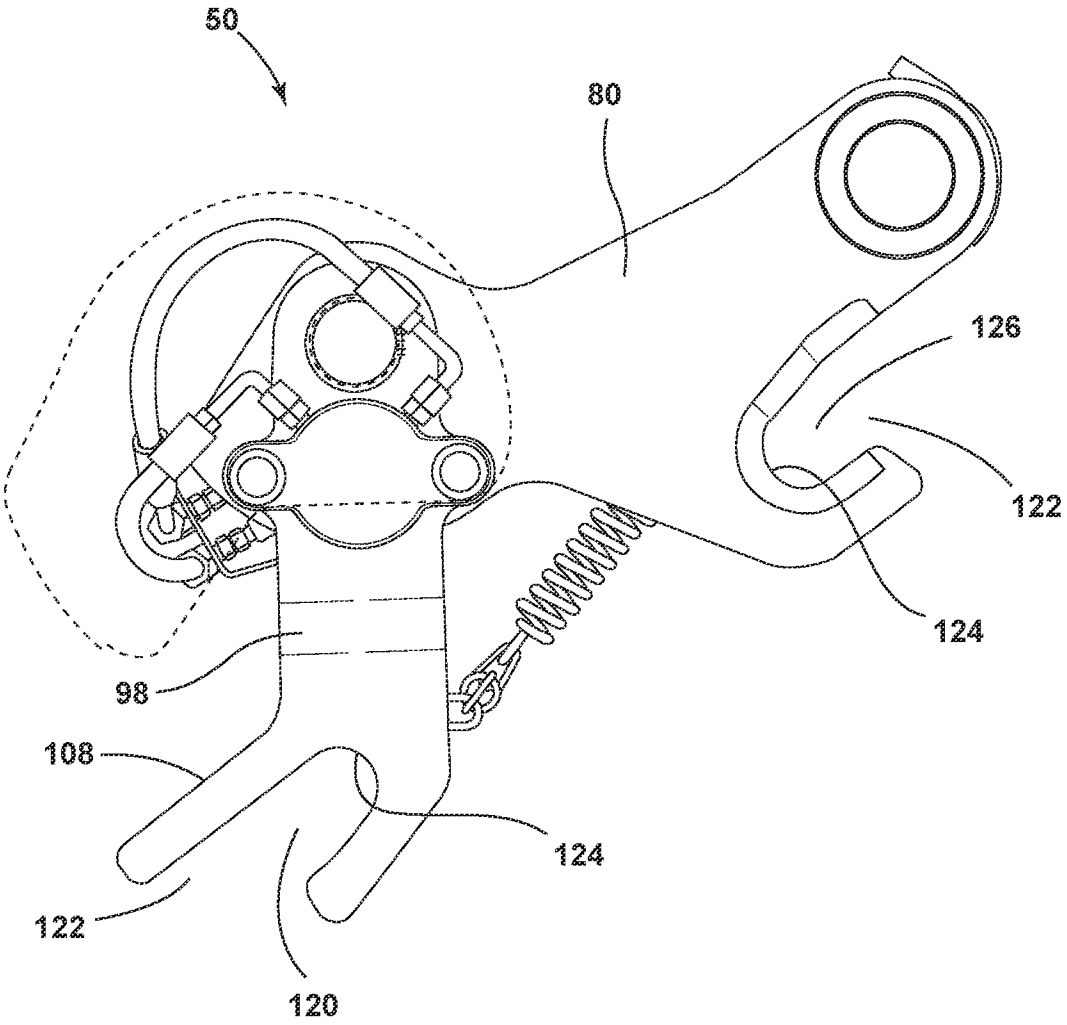
FIG. 3 illustrates a side view of the coupling assembly shown in FIG. 2, particularly illustrating a cam link and a second grip plate of the coupling assembly.

Referring now to FIG. 3, a side view of the coupling assembly 50 shown in FIG. 2 is illustrated. In particular, FIG. 3 illustrates the cam link 80 and the second grip plate 98 of the coupling assembly 50.

As mentioned above, the first grip plate 96 and the second grip plate 98 are coupled to the attachment tool 20. For example, as shown in FIG. 3, the second grip plate 98, and particularly the second end 108 of the second grip plate 98, defines a universal grip plate slot 120. The universal grip plate slot 120 is, in turn, configured to receive a coupling member, such as the second coupling pin 58 (FIG. 2), of the one or more coupling members of the attachment tool 20. The first grip plate 96 (FIG. 2) is substantially the same as the second grip plate 98 in form. As such, the first grip plate 96 (FIG. 2), and particularly the second end 104 of the first grip plate 96 (FIG. 2), also defines a universal grip plate slot 120 substantially the same in form to the universal grip plate slot 120 of the second grip plate 98. The universal grip plate slot 120 of the first grip plate 96 is also configured to receive a coupling member, such as the second coupling pin 58 (FIG. 2), of the one or more coupling members of the attachment tool 20.

The universal grip plate slots 120 of the first and second grip plates 96, 98 (FIG. 2) are also configured to receive various diameters of coupling members. Thus, various configurations of the attachment tool 20 may be coupled to the lift arm assembly 22 using the coupling assembly 50. For example, as shown in FIG. 3, the universal grip plate slot 120 of the second grip plate 98 may extend from an open end 122 to a closed end 124, with the open end 122 being wider than the closed end 124. As such, the width of the universal grip plate slot 120 of the second grip plate 98 may narrow along the length of the universal grip plate slot 120 from the open end 122 to the closed end 124. Likewise, the universal grip plate slot 120 of the first grip plate 96 (FIG. 2) may extend from an open end 122 to a closed end 124, such that the open end 122 is wider than the closed end 124. As such, the width of the universal grip plate slot 120 of the first grip plate 96 (FIG. 2) may narrow along the length of the universal grip plate slot 120 from the open end 122 to the closed end 124. In this regard, the universal grip plate slots 120 of the first grip plate 96 and the second grip plate 98 may be configured to receive various diameters of coupling members.

Likewise, as mentioned above, the cam link 80 is also coupled to the attachment tool 20. For example, the cam link 80 defines a universal cam link slot 126 (FIG. 3) configured to receive a coupling member of the one or more coupling members of the attachment tool 20.

The universal cam link slot 126 is also configured to receive various diameters of coupling members. As such, various configurations of the attachment tool 20 may be coupled to the lift arm assembly 22 via the coupling assembly 50. For example, as shown in FIG. 3, the universal cam link slot 126 may extend from an open end 122 to a closed end 124, with the open end 122 being wider than the closed end 124. As such, the width of the universal cam link slot 126 may narrow along the length of the universal cam link slot 126 from the open end 122 to the closed end 124. In this regard, the universal cam link slot 126 may be configured to receive various diameters of coupling members.

Referring now to FIG. 4, a schematic view of one embodiment of a system 200 for coupling the attachment tool to the lift arm assembly of the construction vehicle 10 is illustrated in accordance with aspects of the present subject matter. In general, the system 200 will be described herein with reference to the construction vehicle 10 described above with reference to FIGS. 1-3. However, it should be appreciated by those of ordinary skill in the art that the disclosed system 200 may generally be utilized with construction vehicles having any suitable vehicle configuration. Additionally, it should be appreciated that, for purposes of illustration, communicative links or electrical couplings of the system 200 shown in FIG. 4 are indicated by dashed lines.

In several embodiments, the system 200 may include a computing system 202 and various other components configured to be communicatively coupled to one or more components of the construction vehicle 10 to allow the operation of such components to be electronically or automatically controlled by the computing system 202, such as the user interface 60 having one or more input devices, and/or various components of the construction vehicle 10 (e.g., actuator(s) 62, 64, 66, first actuator 112, second actuator 114). The user interface 60 described herein may include, without limitation, any combination of input and/or output devices that allow an operator to provide operator inputs to the computing system 202 and/or that allow the computing system 202 to provide feedback to the operator, such as a key board, keypad, pointing device, buttons, knobs, touch sensitive screen, mobile device, audio input device, audio output device, and/or the like.

In general, the computing system 202 may comprise one or more processor-based devices, such as a given controller or computing device or any suitable combination of controllers or computing devices. Thus, in several embodiments, the computing system 202 may include one or more processor(s) 204 and associated memory device(s) 206 configured to perform a variety of computer-implemented functions. As used herein, the term "processor" refers not only to integrated circuits referred to in the art as being included in a computer, but also refers to a controller, a microcontroller, a microcomputer, a programmable logic circuit (PLC), an application specific integrated circuit, and other programmable circuits. Additionally, the memory device(s) 206 of the computing system 202 may generally comprise memory element(s) including, but not limited to, a computer readable medium (e.g., random access memory RAM)), a computer readable non-volatile medium (e.g., a flash memory), a floppy disk, a compact disk-read only memory (CD-ROM), a magneto-optical disk (MOD), a digital versatile disk (DVD) and/or other suitable memory elements. Such memory device(s) 206 may generally be configured to store suitable computer-readable instructions that, when implemented by the processor(s) 204, configure the computing system 202 to perform various computer-implemented functions, such as one or more aspects of the methods and algorithms that will be described herein. In addition, the computing system 202 may also include various other suitable components, such as a communications circuit or module, one or more input/output channels, a data/control bus and/or the like.

In some embodiments, the computing system 202 may be configured to include a communications module or interface 208 to allow for the computing system 202 to communicate with any of the various system components described herein. For example, in several embodiments, the computing system 202 may be communicatively coupled to one or more actuators of the construction vehicle 10, such as the actuator (s) 62, 64, 66, the first actuator 112, and/or the second actuator 114. As shown in FIG. 4, the computing system 202 is communicatively coupled to the first actuator 112 and configured to activate the first actuator 112. In addition, the computing system 202 is communicatively coupled to the second actuator 114 and configured to activate the second actuator 114. The computing system 202 may be communicatively coupled to the first actuator 112 and the second actuator 114 via any suitable connection, such as a wired or wireless connection, to allow the computing system 202 to activate the first actuator 112 and the second actuator 114.

Figure 5:
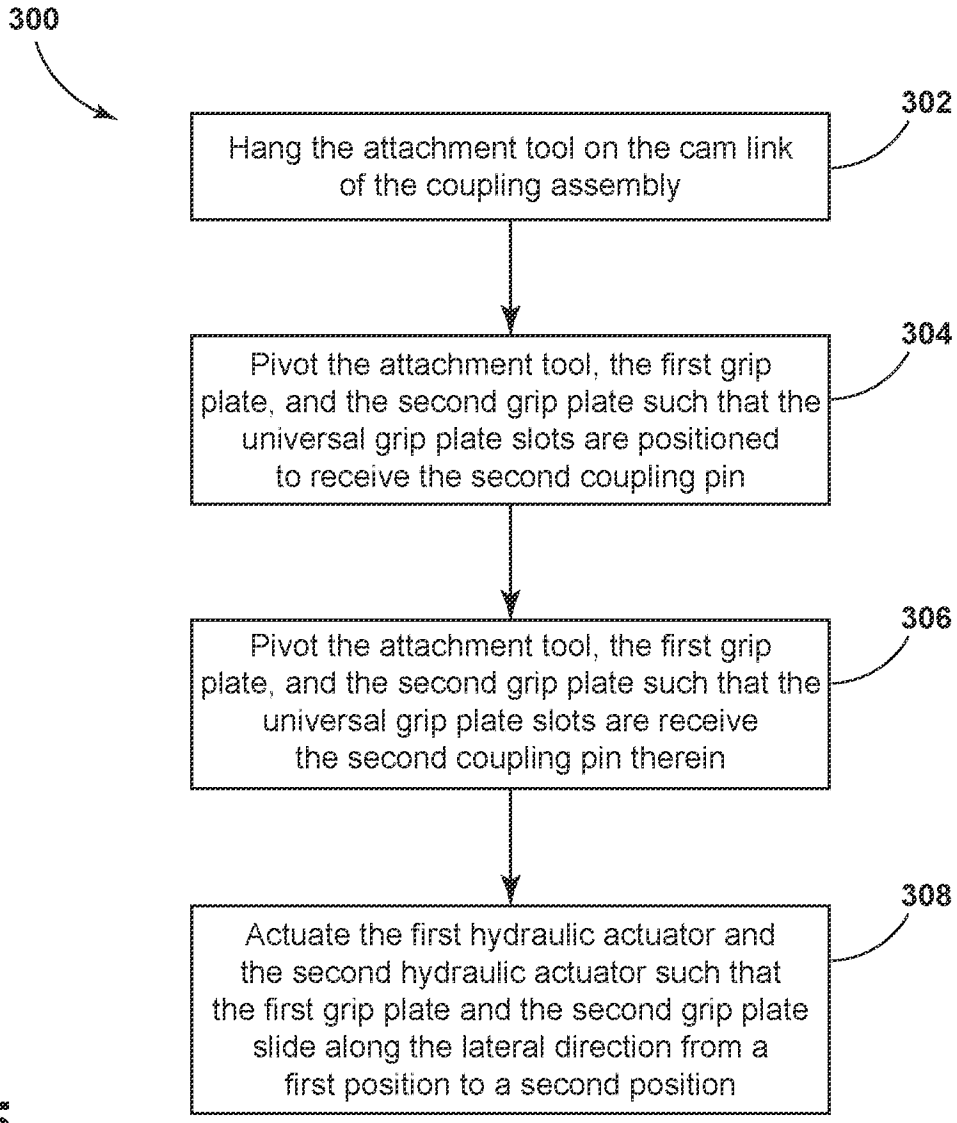
FIG. 5 illustrates a flow diagram of one embodiment of example control logic illustrated in FIGS. 6-9B for coupling the attachment tool to the lift arm assembly of the construction vehicle in accordance with aspects of the present subject matter.

Referring now to FIG. 5, a flow diagram of one embodiment of example control logic 300 illustrated in FIGS. 6-9B for coupling the attachment tool to the lift arm assembly of the construction vehicle 10 is illustrated in accordance with aspects of the present subject matter. In general, the control logic 300 will be described herein with reference to the construction vehicle 10 and the system 200 described above with reference to FIGS. 1-4 and below with reference to FIGS. 6-9B. However, it should be appreciated by those of ordinary skill in the art that the disclosed control logic 300 may generally be implemented with any construction vehicle having any suitable vehicle configuration and/or within any system having any suitable system configuration.

Figure 6:
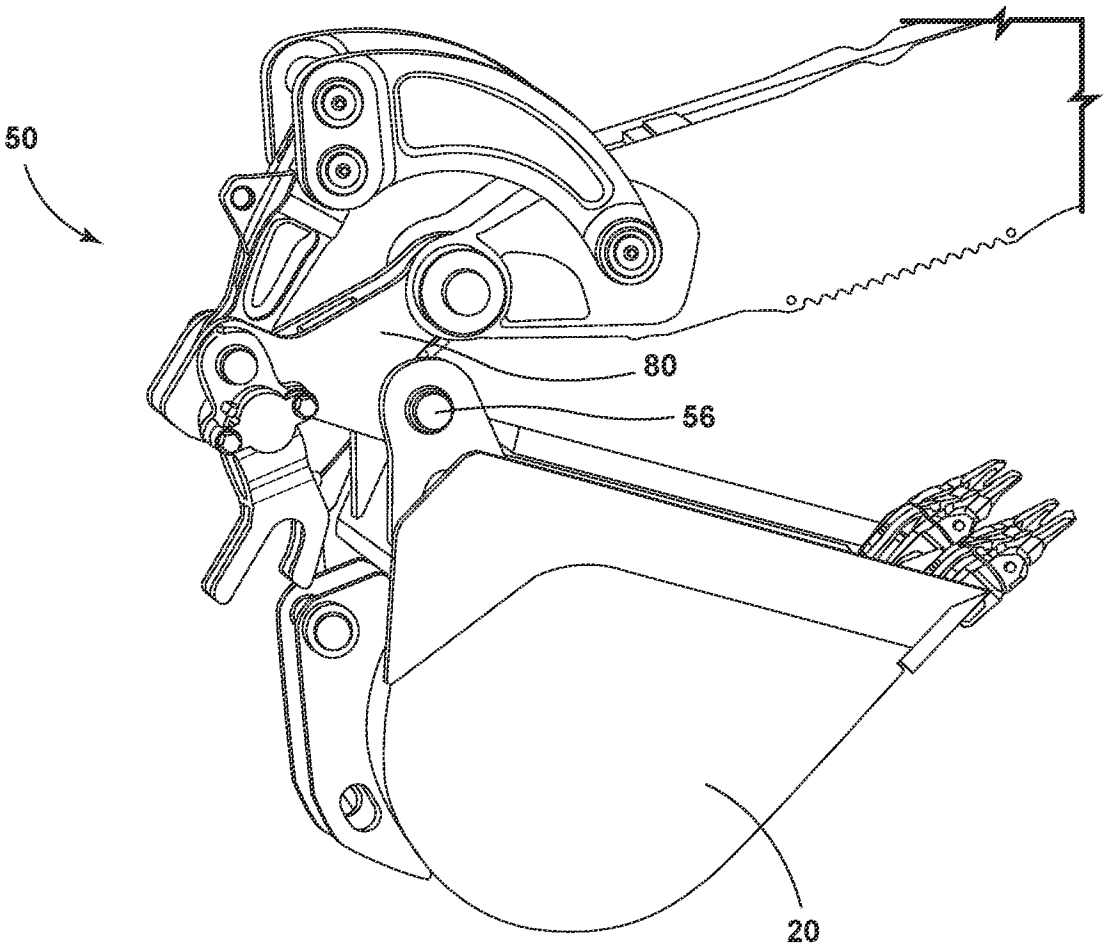
FIG. 6 illustrates a perspective view of the embodiment of the construction vehicle shown in FIG. 1, particularly illustrating the FIG. 5 control logic for coupling the attachment tool to the lift arm assembly of the construction vehicle.

As shown in FIG. 5, at (302), the control logic 300 includes hanging an attachment tool on a cam link of a coupling assembly. For example, as shown in FIG. 6, the first coupling pin 56 of the attachment tool 20 is inserted within the universal cam link slot 126 (FIG. 3) of the cam link 80. As such, upon completion of (302), the attachment tool 20 is pivotable about the first coupling pin 56 relative to the cam link 80.

Figure 7:
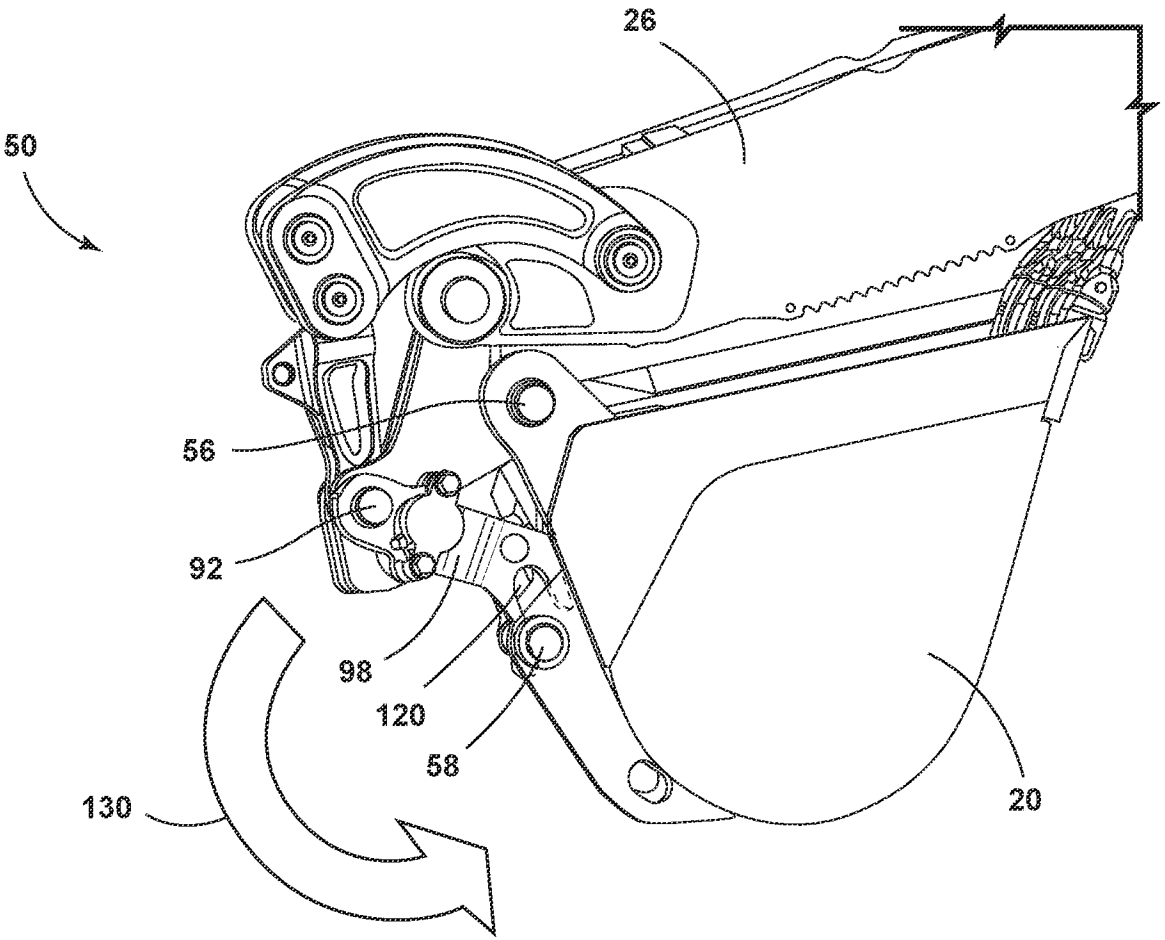
FIG. 7 illustrates a perspective view of the embodiment of the construction vehicle shown in FIG. 1, particularly illustrating the FIG. 5 control logic for coupling the attachment tool to the lift arm assembly of the construction vehicle.

Furthermore, as shown in FIG. 5, at (304), the control logic 300 includes pivoting the attachment tool, a first grip plate, and a second grip plate such that universal grip plate slots of the first grip plate and the second grip plate are positioned to receive a second coupling pin of the attachment tool therein. For example, as shown in FIG. 7, the attachment tool 20 is pivoted about the first coupling pin 56 toward the dipper arm 26 of the lift arm assembly 22 as indicated by a first directional arrow 130. Likewise, the first grip plate 96 (FIG. 2) and the second grip plate 98 are pivoted about the slide pin 92 (e.g., sixth pivot axis 90) toward the attachment tool 20 until the second coupling pin 58 of the attachment tool 20 is positioned to be received within the universal grip plate slots 120 of the first grip plate 96 (FIG. 2) and the second grip plate 98.

Figure 8:
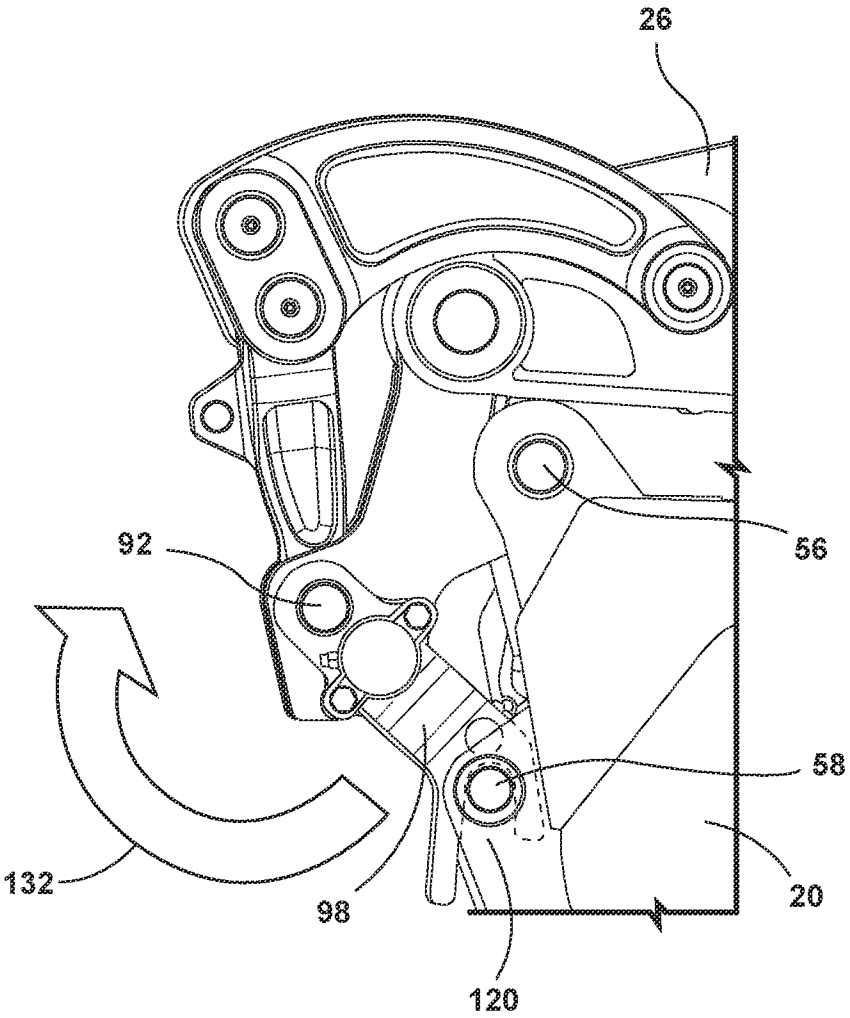
FIG. 8 illustrates a perspective view of the embodiment of the construction vehicle shown in FIG. 1, particularly illustrating the FIG. 5 control logic for coupling the attachment tool to the lift arm assembly of the construction vehicle.

Additionally, as shown in FIG. 5, at (306), the control logic 300 includes pivoting the attachment tool, the first grip plate, and the second grip plate such that universal grip plate slots of the first grip plate and the second grip plate receive the second coupling pin of the attachment tool therein. For example, as shown in FIG. 8, the attachment tool 20 is pivoted about the first coupling pin 56 away from the dipper arm 26 of the lift arm assembly 22 as indicated by a second directional arrow 132. As such, the second coupling pin 58 applies a force to the first grip plate 96 (FIG. 2) and the second grip plate 98 such that the first grip plate 96 (FIG. 2) and the second grip plate 98 are pivoted about the slide pin 92 (e.g., the sixth pivot axis 90) away from the attachment tool 20 until the second coupling pin 58 has been received within the universal grip plate slots 120 of the first grip plate 96 and the second grip plate 98.

Moreover, as shown in FIG. 5, at (308), the control logic 300 includes actuating the first actuator such that the first grip plate slides along the lateral direction relative to the lift arm assembly from a first position to a second position away from the second grip plate. Likewise, at (308), the control logic 300 includes actuating the second actuator such that the second grip plate slides along the lateral direction relative to the lift arm assembly from a first position to a second position away from the first grip plate. For example, as shown in FIGS. 9A and 9B, the first actuator 112 and the second actuator 114 are activated by the computing system 202. As shown in FIGS. 9A and 9B, at (308), the control logic 300 includes actuating the first actuator 112 with the computing system 202 such that the first grip plate 96 slides along the lateral direction 94 relative to the lift arm assembly 22 from the first position to the second position away from the second grip plate 98. Likewise, as shown in FIGS. 9A and 9B, at (308), the control logic 300 includes actuating the second actuator 114 with the computing system 202 such that the second grip plate 98 slides along the lateral direction 94 relative to the lift arm assembly 22 from the first position to the second position away from the first grip plate 96. As shown in FIG. 9A, the first grip plate 96 and the second grip plate 98 are in their respective first positions adjacent to each other. However, when the first actuator 112 and the second actuator 114 are activated, the pistons 110 of the first actuator 112 and the second actuator 114 are configured to apply a force to the cam link 80 such that the first grip plate 96 and the second grip plate 98 slide along the lateral direction 94 relative to the lift arm assembly 22. As such, the first grip plate 96 and the second grip plate 98 slide away from each other and toward their respective second positions. As shown in FIG. 9B, the first grip plate 96 and the second grip plate 98 are in their respective second positions away from each other. As such, the first grip plate 96 and the second grip plate 98 prevent the attachment tool 20 from moving along the lateral direction 94 relative to the lift arm assembly 22 when the first grip plate 96 and the second grip plate 98 are in their respective second positions.

Figure 10A:
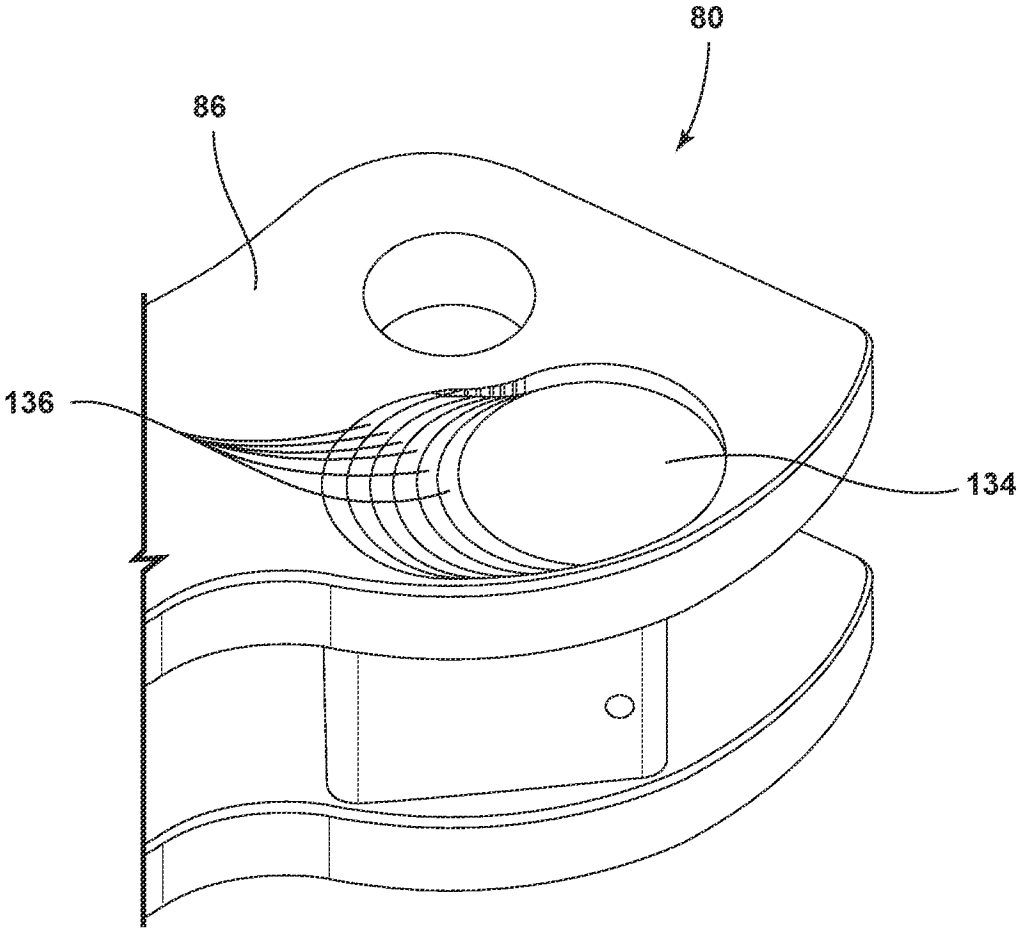
FIG. 10A illustrates a perspective view of a cam link of the coupling assembly of the FIG. 1 embodiment of the construction vehicle, particularly illustrating a first chamber of the cam link and notches therein for locking a piston of the first actuator in place.
Figure 10B:
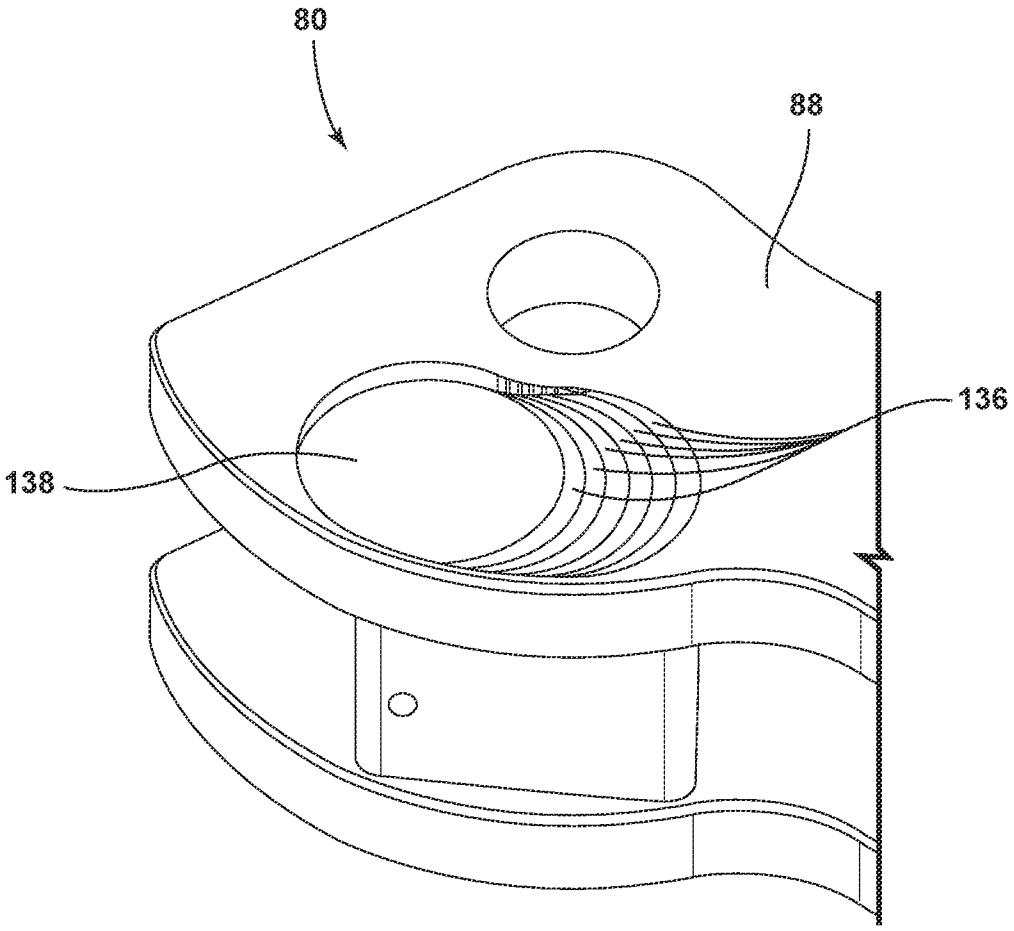
FIG. 10B illustrates a perspective view of a cam link of the coupling assembly of the FIG. 1 embodiment of the construction vehicle, particularly illustrating a second chamber of the cam link and notches therein for locking a piston of the second actuator in place.

Referring now to FIGS. 10A and 10B, differing perspective views of a cam link of the coupling assembly of the FIG. 1 embodiment of the construction vehicle 10 are illustrated. In particular, FIG. 10A illustrates the first side of the cam link 80 and FIG. 10B illustrates the second side of the cam link 80.

The cam link 80 may define a first chamber 134 configured to receive the piston 110 (FIG. 9B) of the first actuator 112 (FIGS. 2, 9B) therein. The first chamber 134 may include a plurality of notches 136 (e.g., machined grooves) therein. Each notch 136 may, in turn, be positioned at a different depth than each other notch 136. Thus, each notch 136 is configured to receive the piston 110 (FIG. 9B) of the first actuator 112 (FIG. 2, 9B) at its corresponding depth therein. For example, as shown in FIG. 10A, the first chamber 134 is defined within the first side 86 of the cam link 80. Each notch 136 is configured to receive the piston 110 (FIG. 9B) of the first actuator 112 (FIG. 2, 9B) therein such that the first grip plate 96 (FIG. 2, 9A, 9B) is fixed relative to the cam link 80 (e.g., about the slide pin 92).

Likewise, the cam link 80 may define a second chamber 138 configured to receive the piston 110 (FIG. 9B) of the second actuator 114 (FIG. 2, 9B) therein. The second chamber 138 may include a plurality of notches 136 (e.g., machined grooves) therein. Each notch 136 may, in turn, be positioned at a different depth than each other notch 136. Thus, each notch 136 is configured to receive the piston 110 (FIG. 9B) of the second actuator 114 (FIG. 2, 9B) at its corresponding depth therein. For example, as shown in FIG. 10B, the second chamber 138 is defined within the second side 88 of the cam link 80. Each notch 136 is configured to receive the piston 110 (FIG. 9B) of the second actuator 114 (FIG. 2, 9B) therein such that the second grip plate 98 (FIG. 2, 9A, 9B) is fixed relative to the cam link 80 (e.g., about the slide pin 92).

Figure 11A:
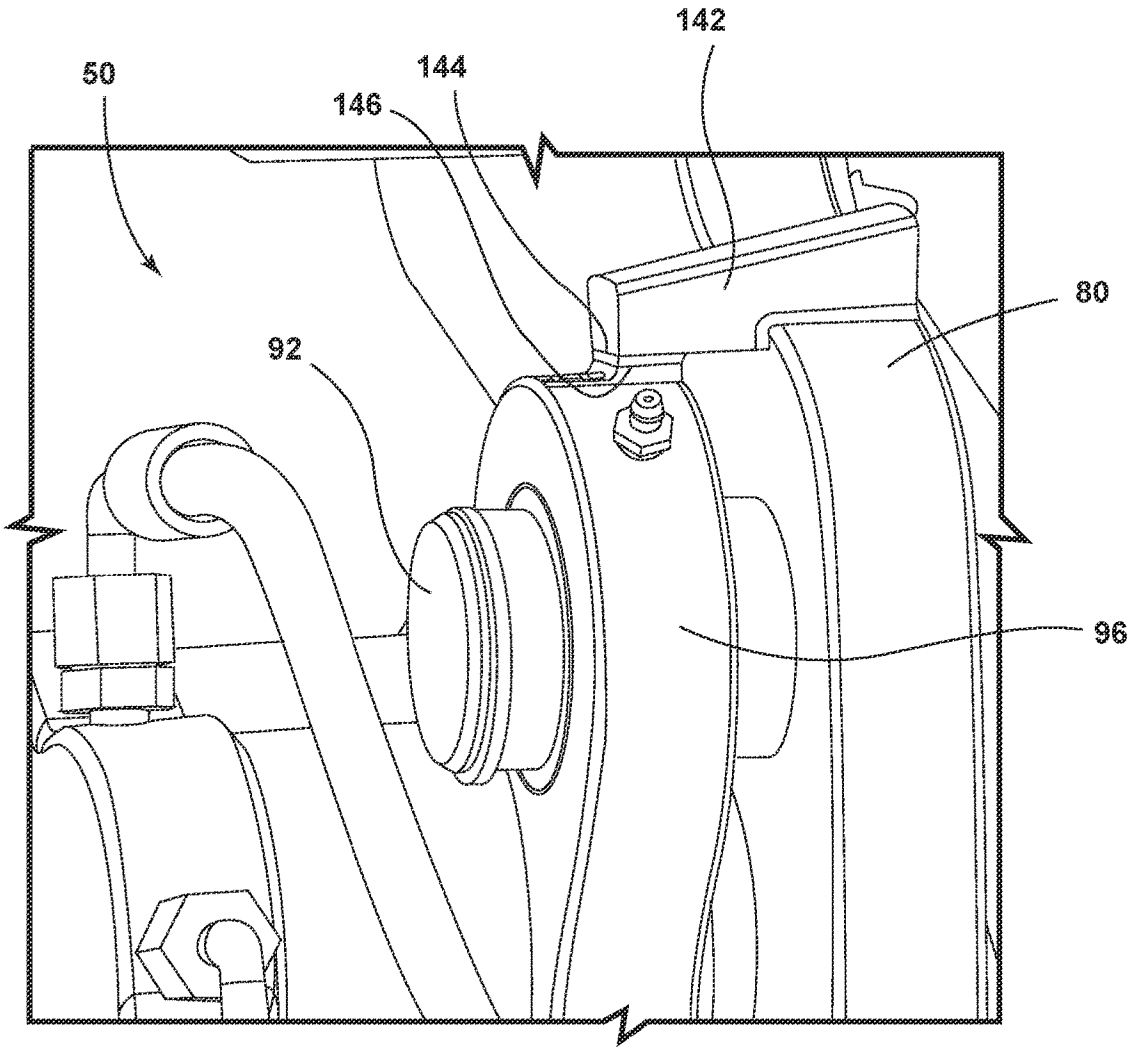
FIG. 11A illustrates a perspective view of the coupling assembly of the FIG. 1 embodiment of the construction vehicle, particularly illustrating a first locking arm locking the first grip plate in place when the first grip plate is in the second position.
Figure 11B:
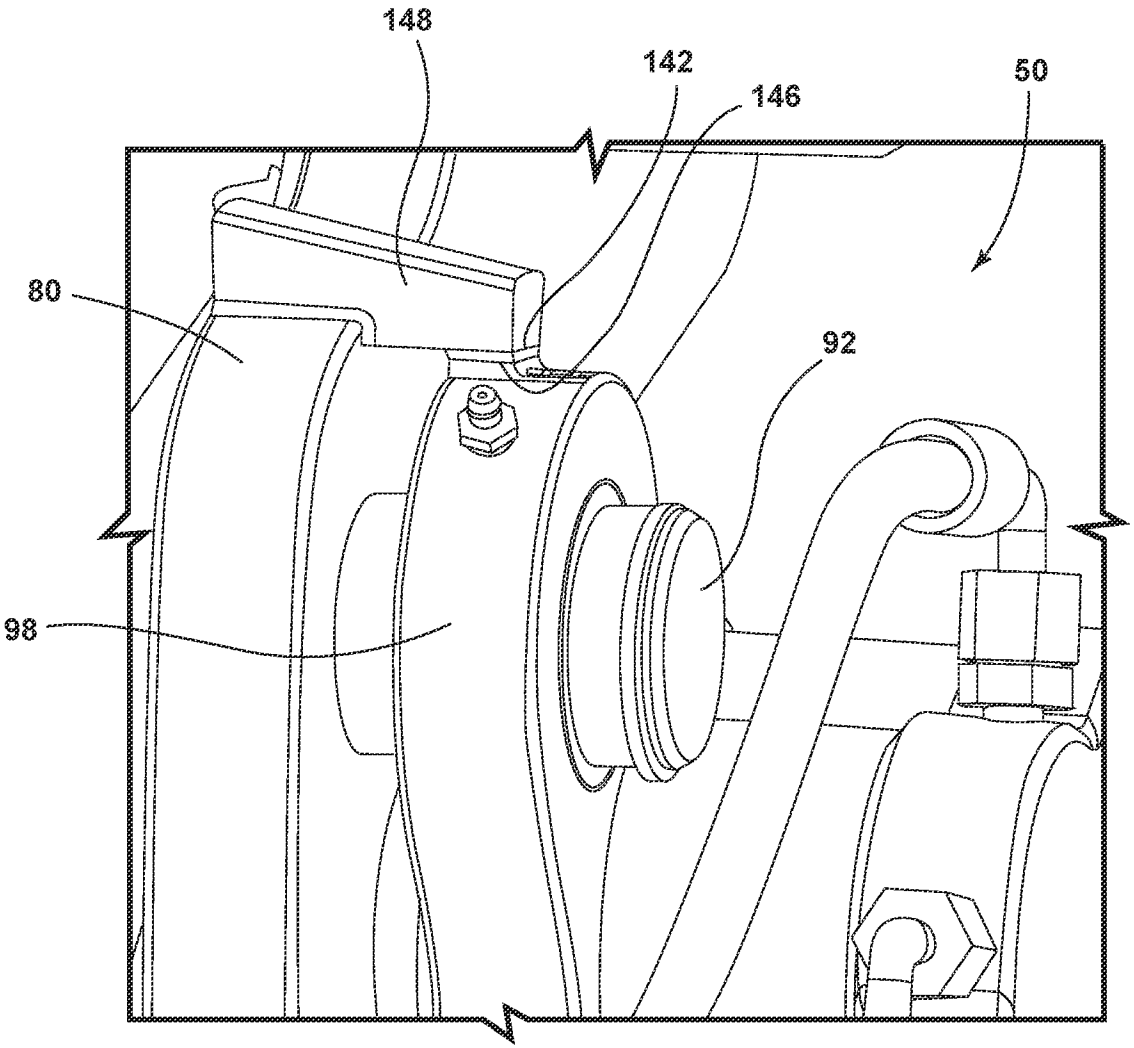
FIG. 11B illustrates a perspective view of the coupling assembly of the FIG. 1 embodiment of the construction vehicle, particularly illustrating a second locking arm locking the second grip plate in place when the second grip plate is in the second position.

Referring now to FIGS. 11A and 11B, differing perspective views of the coupling assembly of the FIG. 1 embodiment of the construction vehicle 10 are illustrated. In particular, FIG. 11A illustrates the first grip plate 96 and a first locking arm 142 of the coupling assembly 50 and FIG. 11B illustrates the second grip plate 98 and a second locking arm 148 of the coupling assembly 50.

As shown in FIG. 11A, the coupling assembly 50 further includes a first locking arm 142 including a set of locking teeth 144. The first grip plate 96 also includes a set of locking teeth 146. As such, when the first grip plate 96 is in the second position, the set of locking teeth 146 of the first grip plate 96 engage the set of locking teeth 144 of the first locking arm 142 such that the first grip plate 96 is fixed about the slide pin 92 (e.g., the sixth pivot axis 90). The first locking arm 142 may be coupled to the cam link 80.

Likewise, as shown in FIG. 11B, the coupling assembly 50 further includes a second locking arm 148 including a set of locking teeth 144. The second grip plate 98 also includes a set of locking teeth 146. As such, when the second grip plate 98 is in the second position, the set of locking teeth 146 of the second grip plate 98 engage the set of locking teeth 144 of the second locking arm 148 such that the second grip plate 98 is fixed about the slide pin 92 (e.g., the sixth pivot axis 90). The second locking arm 148 may be coupled to the cam link 80.

It is to be understood that some of the control logic 300 is performed by the computing system 202 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the computing system 202 described herein, such as the control logic 300, is implemented in software code or instructions which are tangibly stored on a tangible computer readable medium. The computing system 202 loads the software code or instructions via a direct interface with the computer readable medium or via a wired and/or wireless network. Upon loading and executing such software code or instructions by the computing system 202, the computing system 202 may perform any of the functionality of the computing system 202 described herein, including the control logic 300 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A construction vehicle, comprising:

a frame;

a lift arm assembly pivotably coupled to the frame;

an attachment tool comprising a coupling member; and a coupling assembly to couple the attachment tool to the lift arm assembly, the coupling assembly comprising:

a first grip plate defining a universal grip plate slot configured to receive the coupling member of the attachment tool therein, the first grip plate configured to slide along a lateral direction relative to the lift arm assembly between first and second positions;

a second grip plate defining a universal grip plate slot configured to receive the coupling member of the attachment tool therein, the second grip plate configured to slide along the lateral direction relative to the lift arm assembly between first and second positions;

a first actuator comprising a piston wherein, operation of the first actuator moves the piston of the first actuator relative to the first grip plate, the piston of the first actuator configured to apply indirect pressure to the first grip plate whereby the first grip plate slides along the lateral direction away from the second grip plate; and a second actuator comprising a piston wherein, operation of the second actuator moves the piston of the second actuator relative to the second grip plate, the piston of the second actuator configured to apply indirect pressure to the second grip plate whereby the second grip plate slides along the lateral direction away from the first grip plate; and wherein, the first and second grip plates are configured to prevent the attachment tool from moving along the lateral direction relative to the lift arm assembly while the first and second grip plates are in their respective second positions.

2. The construction vehicle of claim 1, wherein the coupling assembly further comprises:

a cam link pivotably coupled to the lift arm assembly at a first end of the cam link, wherein, the first grip plate and the second grip plate are pivotably coupled to the cam link at a second end of the cam link such that the first grip plate and the second grip plate are pivotable about an axis extending along the lateral direction relative to the cam link and are moveable along the lateral direction relative to the cam link, wherein, when actuating the first grip plate, the first actuator is configured to slide the first grip plate along the lateral direction away from the second grip plate, and wherein, when actuating the second grip plate, the second actuator is configured to slide the second grip plate along the lateral direction away from the first grip plate.

3. The construction vehicle of claim 2, the coupling assembly further comprising:

a first locking arm including a set of locking teeth; and a second locking arm including a set of locking teeth, wherein the first grip plate includes a set of locking teeth configured to engage the set of locking teeth of the first locking arm when the first grip plate is in the second position, such that the first grip plate is prevented from pivoting about the axis extending along the lateral direction relative to the lift arm assembly, and wherein the second grip plate includes a set of locking teeth configured to engage the set of locking teeth of the second locking arm when the second grip plate is in the second position, such that the second grip plate is prevented from pivoting about the axis extending along the lateral direction relative to the lift arm assembly.

4. The construction vehicle of claim 2, wherein:

the first actuator is configured as a first hydraulic actuator, the piston of the first hydraulic actuator coupled to the first grip plate; and the second actuator is configured as a second hydraulic actuator, the piston of the second hydraulic actuator coupled to the second grip plate.

5. The construction vehicle of claim 4, further comprising:

a locking valve configured to prevent at least one of the first hydraulic actuator or the second hydraulic actuator from losing a fluid pressure.

6. The construction vehicle of claim 4, wherein the coupling assembly further comprises:

at least one hydraulic tube coupled to the first hydraulic actuator and the second hydraulic actuator, wherein, the cam link includes a first side and a second side spaced apart from the first side such that the cam link is configured to receive the at least one hydraulic tube between the first side and the second side.

7. The construction vehicle of claim 4, wherein:

the first grip plate defines a piston hole configured to receive the piston of the first hydraulic actuator such that when the first hydraulic actuator is activated, the piston of the first hydraulic actuator is configured to apply a force to the cam link to slide the first grip plate along the lateral direction away from the cam link; and the second grip plate defines a piston hole configured to receive the piston of the second hydraulic actuator such that when the second hydraulic actuator is activated, the piston of the second hydraulic actuator is configured to apply a force to the cam link to slide the second grip plate along the lateral direction away from the cam link.

8. The construction vehicle of claim 7, wherein:

the cam link defines a first chamber configured to receive the piston of the first hydraulic actuator therein and a second chamber configured to receive the piston of the second hydraulic actuator therein, wherein, the first chamber includes a plurality of notches therein, each notch of the plurality of notches at a different depth than each other notch of the plurality of notches and configured to receive the piston of the first hydraulic actuator therein such that the first grip plate is fixed relative to the cam link, and wherein the second chamber includes a plurality of notches therein, each notch of the plurality of notches at a different depth than each other notch of the plurality of notches and configured to receive the piston of the second hydraulic actuator therein such that the second grip plate is fixed relative to the cam link.

9. The construction vehicle of claim 1, wherein:

the universal grip plate slot of the first grip plate extends from an open end to a closed end, wherein the open end is wider than the closed end; and the universal grip plate slot of the second grip plate extends from an open end to a closed end, wherein the open end is wider than the closed end.

10. The construction vehicle of claim 1, further comprising:

a computing system communicatively coupled to the first actuator and the second actuator and configured to activate the first actuator and the second actuator.

11. A system for coupling an attachment tool to a lift arm assembly of a construction vehicle, the system comprising:

a first grip plate defining a universal grip plate slot configured to receive a coupling member of an attachment tool therein, the first grip plate configured to slide along a lateral direction relative to a lift arm assembly between first and second positions;

a second grip plate defining a universal grip plate slot configured to receive the coupling member of the attachment tool therein, the second grip plate configured to slide along the lateral direction relative to the lift arm assembly between first and second positions;

a first actuator comprising a piston wherein, operation of the first actuator moves the piston of the first actuator relative to the first grip plate, the piston of the first actuator configured to apply indirect pressure to the first grip plate whereby the first grip plate slides along the lateral direction away from the second grip plate; and a second actuator comprising a piston wherein, operation of the second actuator moves the piston of the second actuator relative to the second grip plate, the piston of the second actuator configured to apply indirect pressure to the second grip plate whereby the second grip plate slides along the lateral direction away from the first grip plate; and wherein, the first and second grip plates are configured to prevent the attachment tool from moving along the lateral direction relative to the lift arm assembly while the first and second grip plates are in their respective second positions.

12. The system of claim 11, further comprising:

a cam link pivotably coupled to the lift arm assembly at a first end of the cam link, wherein, the first grip plate and the second grip plate are pivotably coupled to the cam link at a second end of the cam link such that the first grip plate and the second grip plate are pivotable about an axis extending along the lateral direction relative to the cam link and are moveable along the lateral direction relative to the cam link, wherein, when actuating the first grip plate, the first actuator is configured to slide the first grip plate along the lateral direction away from the second grip plate, and wherein, when actuating the second grip plate, the second actuator is configured to slide the second grip plate along the lateral direction away from the first grip plate.

13. The system of claim 12, further comprising:

a first locking arm including a set of locking teeth; and a second locking arm including a set of locking teeth, wherein the first grip plate includes a set of locking teeth configured to engage the set of locking teeth of the first locking arm when the first grip plate is in the second position, such that the first grip plate is prevented from pivoting about the axis extending along the lateral direction relative to the lift arm assembly, and wherein the second grip plate includes a set of locking teeth configured to engage the set of locking teeth of the second locking arm when the second grip plate is in the second position, such that the second grip plate is prevented from pivoting about the axis extending along the lateral direction relative to the lift arm assembly.

14. The system of claim 12, wherein:

the first actuator is configured as a first hydraulic actuator, the piston of the first hydraulic actuator coupled to the first grip plate; and the second actuator is configured as a second hydraulic actuator, including a the piston of the second hydraulic actuator coupled to the second grip plate.

15. The system of claim 14, further comprising:

at least one hydraulic tube coupled to the first hydraulic actuator and the second hydraulic actuator, wherein, the cam link includes a first side and a second side spaced apart from the first side such that the cam link is configured to receive the at least one hydraulic tube between the first side and the second side.

16. The system of claim 14, wherein:

the first grip plate defines a piston hole configured to receive the piston of the first hydraulic actuator such that when the first hydraulic actuator is activated, the piston of the first hydraulic actuator is configured to apply a force to the cam link to slide the first grip plate along the lateral direction away from the cam link; and the second grip plate defines a piston hole configured to receive the piston of the second hydraulic actuator such that when the second hydraulic actuator is activated, the piston of the second hydraulic actuator is configured to apply a force to the cam link to slide the second grip plate along the lateral direction away from the cam link.

17. The system of claim 16, wherein:

the cam link defines a first chamber configured to receive the piston of the first hydraulic actuator therein and a second chamber configured to receive the piston of the second hydraulic actuator therein, wherein, the first chamber includes a plurality of notches therein, each notch of the plurality of notches at a different depth than each other notch of the plurality of notches and configured to receive the piston of the first hydraulic actuator therein such that the first grip plate is fixed relative to the cam link, and wherein the second chamber includes a plurality of notches therein, each notch of the plurality of notches at a different depth than each other notch of the plurality of notches and configured to receive the piston of the second hydraulic actuator therein such that the second grip plate is fixed relative to the cam link.

18. The system of claim 17, further comprising:

a locking valve configured to prevent at least one of the first hydraulic actuator or the second hydraulic actuator from losing a fluid pressure.

19. The system of claim 11, wherein:

the universal grip plate slot of the first grip plate extends from an open end to a closed end, wherein the open end is wider than the closed end; and the universal grip plate slot of the second grip plate extends from an open end to a closed end, wherein the open end is wider than the closed end.

20. The system of claim 11, further comprising:

a computing system communicatively coupled to the first actuator and the second actuator and configured to activate the first actuator and the second actuator.

21. A construction vehicle, comprising:

a frame;

a lift arm assembly pivotably coupled to the frame;

an attachment tool comprising a coupling member; and a coupling assembly to couple the attachment tool to the lift arm assembly, the coupling assembly comprising:

a cam link pivotably coupled to the lift arm assembly at a first end of the cam link;

a first grip plate defining a universal grip plate slot configured to receive the coupling member of the attachment tool therein, the first grip plate configured to slide along a lateral direction relative to the lift arm assembly between first and second positions;

a second grip plate defining a universal grip plate slot configured to receive the coupling member of the attachment tool therein, the second grip plate configured to slide along the lateral direction relative to the lift arm assembly between first and second positions;

a first hydraulic actuator including a piston coupled to the first grip plate, the first hydraulic actuator configured to actuate the first grip plate whereby the first grip plate slides along the lateral direction away from the second grip plate; and a second hydraulic actuator including a piston coupled to the second grip plate, the second hydraulic actuator configured to actuate the second grip plate whereby the second grip plate slides along the lateral direction away from the first grip plate; and wherein:

the first and second grip plates are configured to prevent the attachment tool from moving along the lateral direction relative to the lift arm assembly while the first and second grip plates are in their respective second positions;

the first and second grip plates are pivotably coupled to the cam link at a second end of the cam link whereby the first and second grip plates are pivotable about an axis extending along the lateral direction relative to the cam link and are moveable along the lateral direction relative to the cam link; and when actuating the first and second grip plates, the first and second hydraulic actuators are configured to slide the first and second grip plates respectively along the lateral direction away from each other.

* * * * *